US011529002B2

(12) United States Patent
Mountz et al.

(10) Patent No.: US 11,529,002 B2
(45) Date of Patent: Dec. 20, 2022

(54) BASSINET FRAME

(71) Applicant: Wonderland Switzerland AG, Steinhausen (CH)

(72) Inventors: Jonathan K. Mountz, Birdsboro, PA (US); Lance J. Clemmer, Mohnton, PA (US)

(73) Assignee: WONDERLAND SWITZERLAND AG, Steinhausen (CH)

( * ) Notice: Subject to any disclaimer, the term of this patent is extended or adjusted under 35 U.S.C. 154(b) by 0 days.

(21) Appl. No.: 16/867,747

(22) Filed: May 6, 2020

(65) Prior Publication Data

US 2020/0352351 A1 Nov. 12, 2020

Related U.S. Application Data

(60) Provisional application No. 62/886,591, filed on Aug. 14, 2019, provisional application No. 62/844,341, filed on May 7, 2019.

(51) Int. Cl.
*A47D 9/00* (2006.01)

(52) U.S. Cl.
CPC ..... *A47D 9/005* (2013.01)

(58) Field of Classification Search
CPC . A47D 9/00; A47D 9/005; A47D 9/02; A47D 9/04; A47D 7/00; A47D 7/002; A47D 11/005; A47D 11/007
See application file for complete search history.

(56) References Cited

U.S. PATENT DOCUMENTS

| | | | | |
|---|---|---|---|---|
| 5,802,634 | A * | 9/1998 | Onishi | A47D 9/02 5/93.1 |
| 6,467,108 | B1 * | 10/2002 | Wang | A47D 13/063 5/99.1 |
| 9,138,070 | B1 * | 9/2015 | Shamie | A47D 7/002 |
| 2018/0146796 | A1 * | 5/2018 | Longenecker | A47D 13/063 |
| 2019/0254442 | A1 * | 8/2019 | Tuckey | A47D 15/003 |

FOREIGN PATENT DOCUMENTS

| | | | |
|---|---|---|---|
| CN | 204970477 | U | 1/2016 |
| CN | 206612461 | U | 11/2019 |
| GB | 2471937 | A | 1/2011 |

OTHER PUBLICATIONS

GB Search report for GB Application No. 2006548.8, dated Sep. 29, 2020, 4 pages.

* cited by examiner

*Primary Examiner* — Peter M. Cuomo
*Assistant Examiner* — George Sun
(74) *Attorney, Agent, or Firm* — Cantor Colburn LLP

(57) ABSTRACT

A bassinet frame includes a support frame, two leg units, and two pivot hubs each connecting a respective one of the leg units to the support frame. Each of the leg units is pivotable relative to the support frame between a folded position, wherein a foot portion of the leg unit is proximal to the support frame, and an unfolded position, wherein the foot portion is distal from the support frame. When each of the leg units is at the unfolded position, a locking pin of the respective pivot hub is movable between a stopping position, wherein the locking pin prevents a respective one of the leg units from moving toward the folded position, and a releasing position, wherein movement of the respective leg unit toward the folded position is permitted.

14 Claims, 16 Drawing Sheets

BASSINET FRAME

CROSS-REFERENCE TO RELATED APPLICATION

This application claims priority of U.S. Provisional Application No. 62/844,341, filed on May 7, 2019, and U.S. Provisional. Application No. 62/886,591, filed on Aug. 14, 2019.

FIELD

The disclosure relates to a bassinet frame, more particularly to foldable bassinet frame.

BACKGROUND

A bassinet is designed to provide a safe sleeping area for a child and is often required to be positioned at different heights in different situations. A conventional bassinet has a height-adjusting mechanism which has a complex structure and heavy weight, making height adjustment of the conventional bassinet difficult and the conventional bassinet inconvenient to transport.

SUMMARY

Therefore, the object of the disclosure is to provide a bassinet frame that can alleviate at least one of the drawbacks of the prior art.

According to the disclosure, a bassinet frame includes a support frame, two leg units, and two pivot hubs each connecting a respective one of the leg units to the support frame.

Each of the leg units has a pivot end portion pivotally connected to a respective one of the pivot hubs, and a foot portion opposite to the pivot end portion.

Each of the leg units is pivotable relative to the support frame between a folded position, where the foot portion is proximal to the support frame, and an unfolded position, where the foot portion is distal from the support frame.

Each of the pivot hubs includes a locking pin. When each of the leg units is at the unfolded position, the locking pin of the respective pivot hub is movable between a stopping position, where the locking pin prevents a respective one of the leg units from moving toward the folded position, and a releasing position, where movement of the respective leg unit toward the folded position is permitted.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
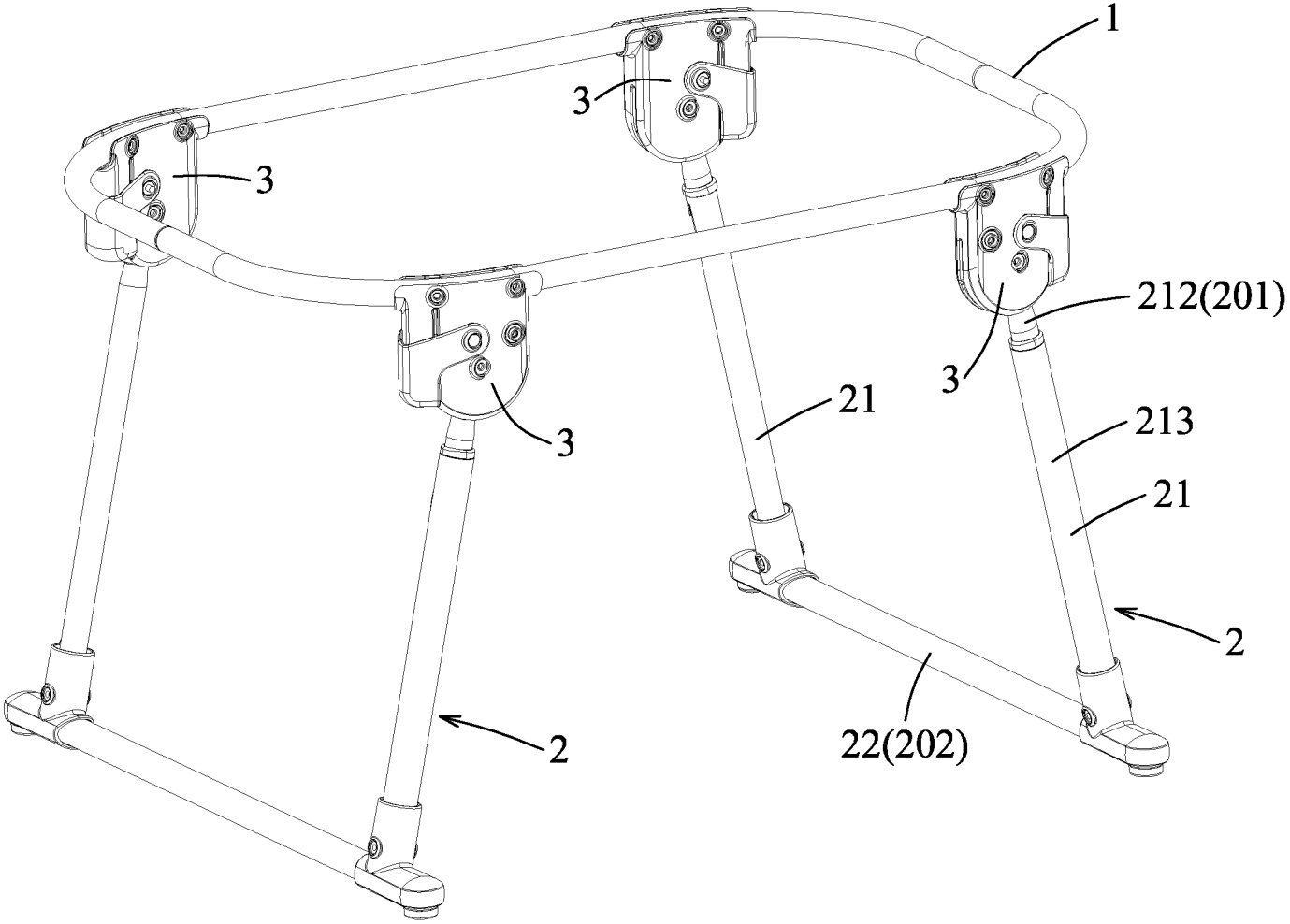
FIG. 1 is a perspective view of a first embodiment of a bassinet frame according to the disclosure, illustrating leg units of the bassinet frame each at an unfolded position.

Before the present subject matter is described in greater detail, it should be noted that where considered appropriate, reference numerals or terminal portions of reference numerals have been repeated among the figures to indicate corresponding or analogous elements, which may optionally have similar characteristics.

Figure 2:
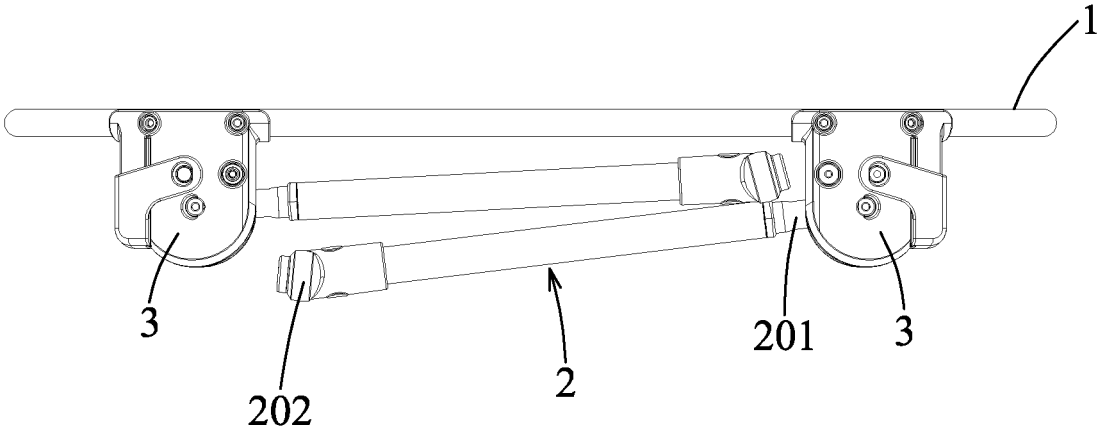
FIG. 2 is a side view of the first embodiment illustrating each of the leg units being at a folded position.

Referring to FIGS. 1 and 2, a first embodiment of a bassinet frame includes a substantially rectangular support frame 1, two leg units 2 disposed at opposite sides of the support frame 1, and four pivot hubs 3 connected respectively to four corners of the support frame 1. Each of the pivot hubs 3 connects a corresponding one of the leg units 2 to the support frame 1. One of the leg units 2 is connected to two of the pivot hubs 3, and the other one of the leg units 2 is connected to the other two of the pivot hubs 3.

Specifically, each of the leg units 2 has a pivot end portion 201 pivotally connected to the corresponding two of the pivot hubs 3, and a foot portion 202 opposite to the pivot end portion 201. Each of the leg units 2 is pivotable relative to the support frame 1 between a folded position (see FIG. 2), where the foot portion 202 is proximal to the support frame 1, and an unfolded position (see FIG. 1), where the foot portion 202 is distal from the support frame 1. The structure of the bassinet frame is symmetrical in left-right and front-rear directions, so that only one leg unit 2 and a corresponding pivot hub 3 will be described hereinafter for the sake of brevity.

Figure 3:
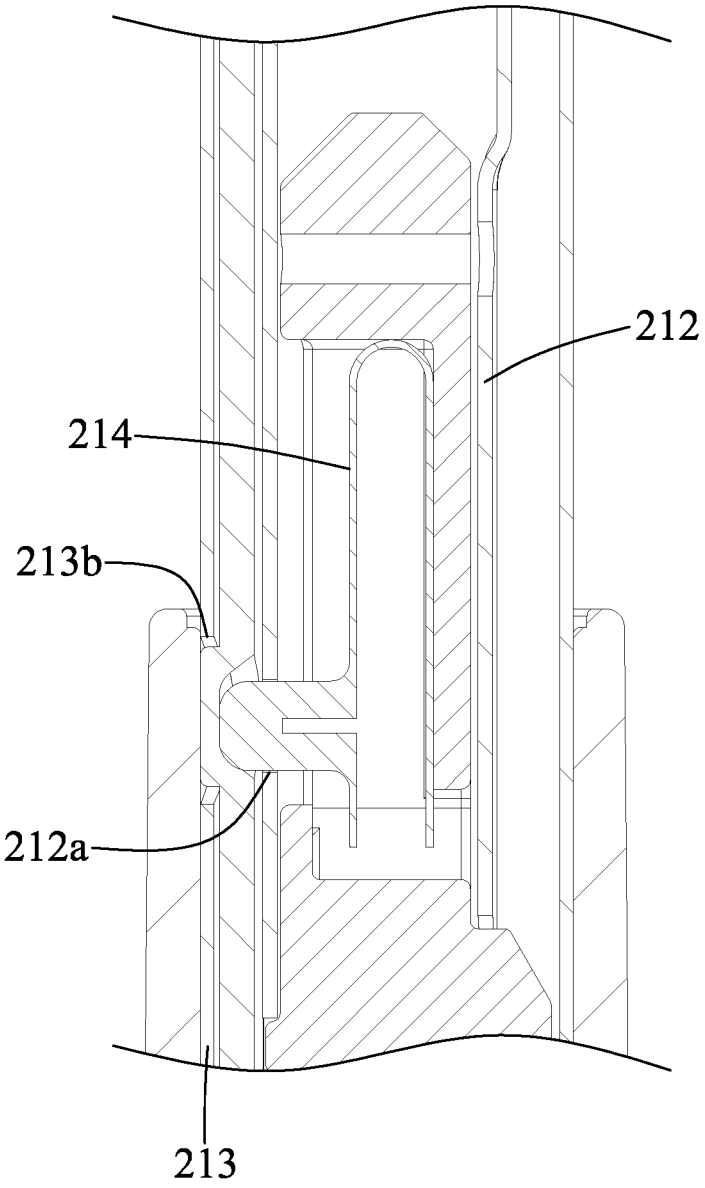
FIG. 3 is a fragmentary sectional view of a leg of each leg unit of the first embodiment, illustrating the leg in an collapsed state.
Figure 4:
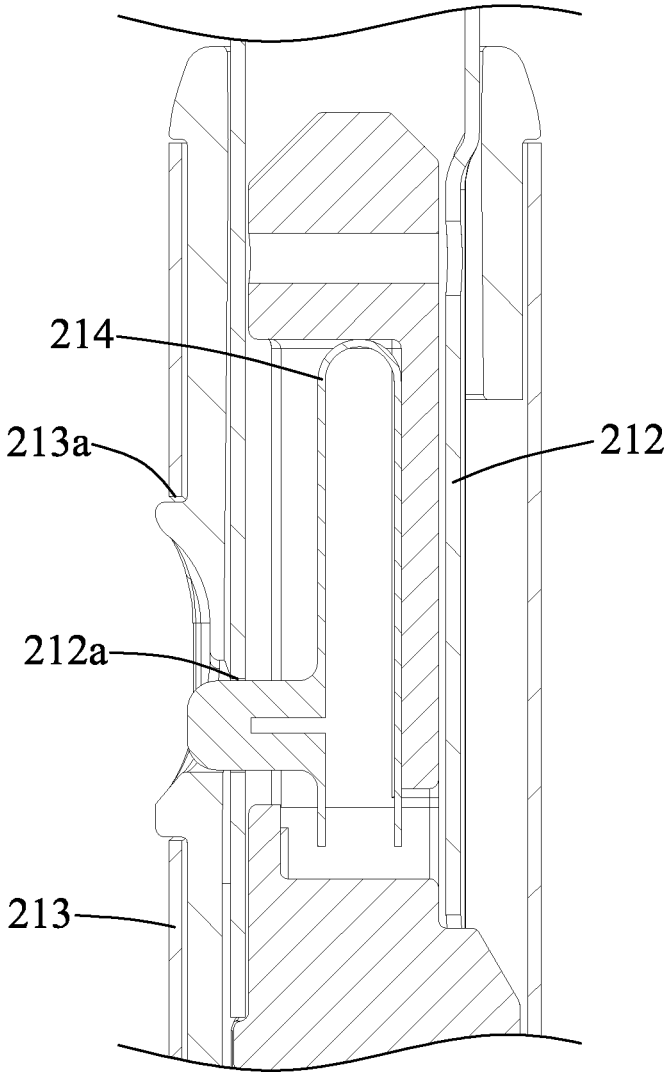
FIG. 4 is a fragmentary sectional view of the leg of the first embodiment, illustrating the leg in an extended state.

In this embodiment, the leg unit 2 includes two legs 21 and a foot bar 22. Further referring to FIGS. 3 and 4, each of the legs 21 includes an inner tube 212 and an outer tube 213 coupled telescopically to each other, and a tube fastener 214. The inner tubes 212 of the legs 21 are connected pivotally to the support frame 1 via corresponding pivot hubs 3 and serve as the pivot end portion 201 of the leg unit 2. The foot bar 22 interconnects the outer tubes 213 of the legs 21 and serves as the foot portion 202 of the leg unit 2.

For each of the legs 21, the inner tube 212 has an inner fastening hole 212*a*, the outer tube 213 has an outer fastening hole 213*a* and an outer fastening groove 213*b*, and the tube fastener 214 extends into the inner fastening hole 212*a* and is operable to extend retractably through the outer fastening hole 213*a* or into the outer fastening groove 213*b* for positioning the inner tube 212 relative to the outer tube 213. In this embodiment, for each of the legs 21, the inner fastening hole 212*a* is positioned distal from the support frame 1, and the outer fastening hole and groove 213*a*, 213*b* are respectively distal from and proximal to the foot bar 22. Each of the legs 21 is secured in an extended state (see FIG. 4) when the fastener 214 extends through the inner and outer fastening holes 212*a*, 213*a*, and is secured in a collapsed state (see FIG. 3) when the fastener 214 extends through the inner fastening hole 212*a* into the outer fastening groove 213*b*. To change each of the legs 21 from the collapsed state, the outer tube 213 is pulled downward with enough force so that the tube fastener 211 is disengaged from the outer fastening groove 213*b*. To change each of the legs 21 from the extended state, the tube fastener 214 needs to be operated through the outer fastening hole 213*a* to be disengaged from the outer fastening hole 213*a*. In this embodiment, the fastener 214 is a Valco snap button.

Figure 5:
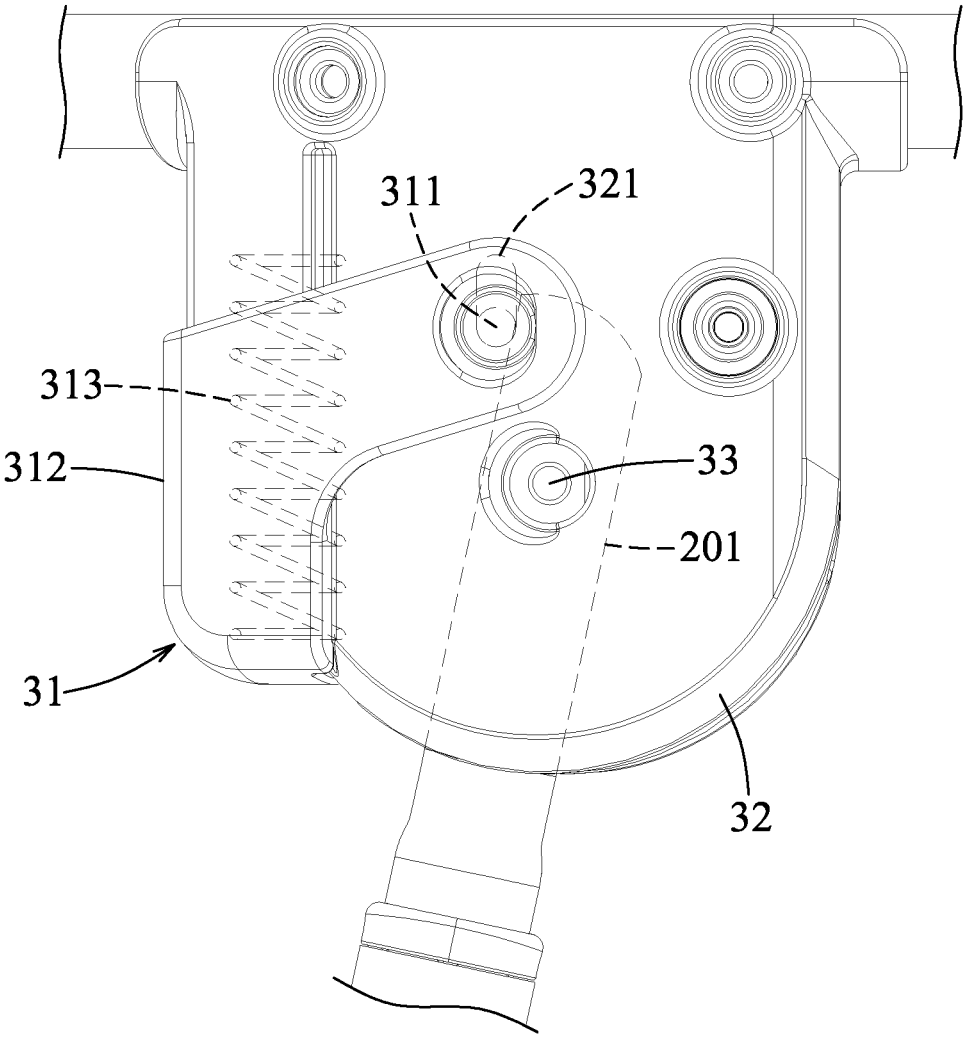
FIG. 5 is a fragmentary side view of the first embodiment, illustrating a locking pin of a pivot hub at a stopping position and a corresponding leg unit at the unfolded position.
Figure 6:
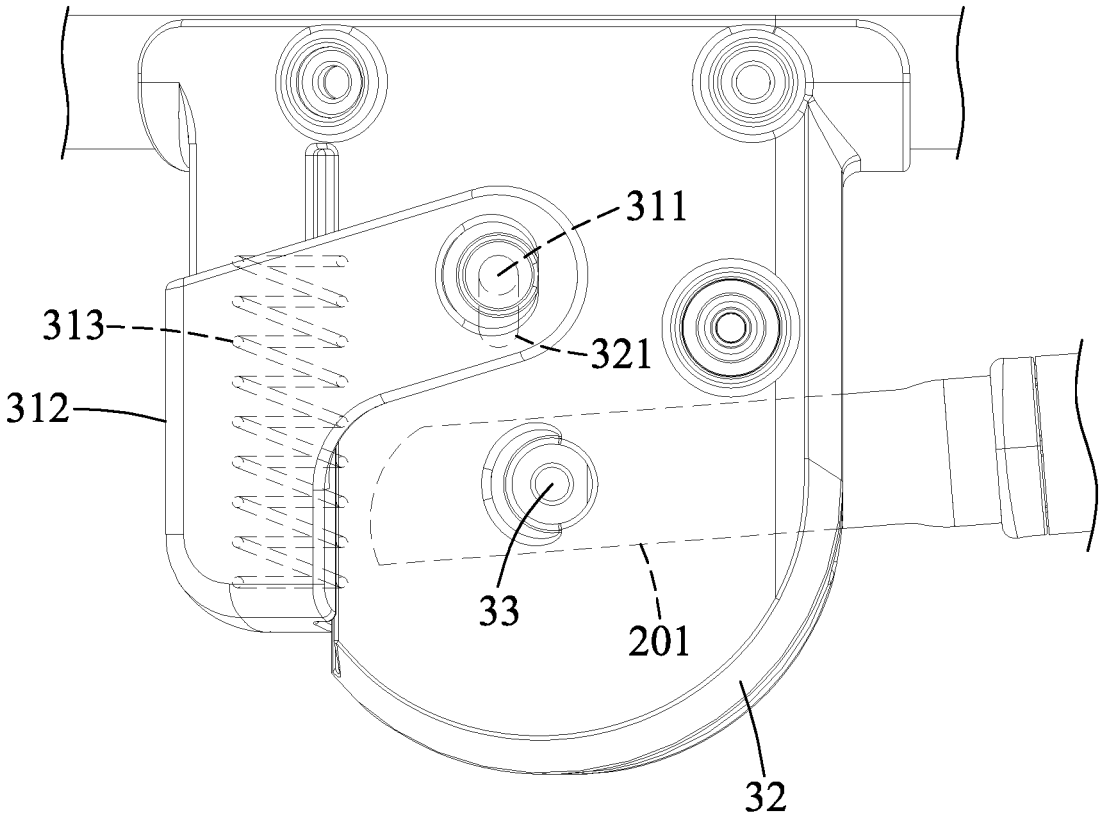
FIG. 6 is similar to FIG. 5 but illustrating the locking pin at a releasing position and the corresponding leg unit at the folded position.

Referring to FIGS. 1, 5 and 6, the pivot hub 3 includes a locking unit 31, a hub housing 32 mounted to the support frame 1, and a pivot rivet 33 pivotally connected to the pivot end portion 201 of the leg unit 2. The locking unit 31 has a locking pin 311, an operating member 312 connected to the locking pin 311, and a locking resilient member 313 disposed between the support frame 1 and the operating member 312.

When the leg unit 2 is at the unfolded position, the locking pin 311 is movable between a stopping position (see FIG. 5), where the locking pin 311 abuts against the leg unit 2 to prevent the leg unit 2 from moving toward the folded position, and a releasing position (see FIG. 6), where movement of the respective leg unit 2 toward the folded position is permitted without being interfered by the locking pin 311. The operating member 312 is operable to move the locking pin 311 against a resilient force of the locking resilient member 313 from the stopping position to the releasing position.

Figure 7:
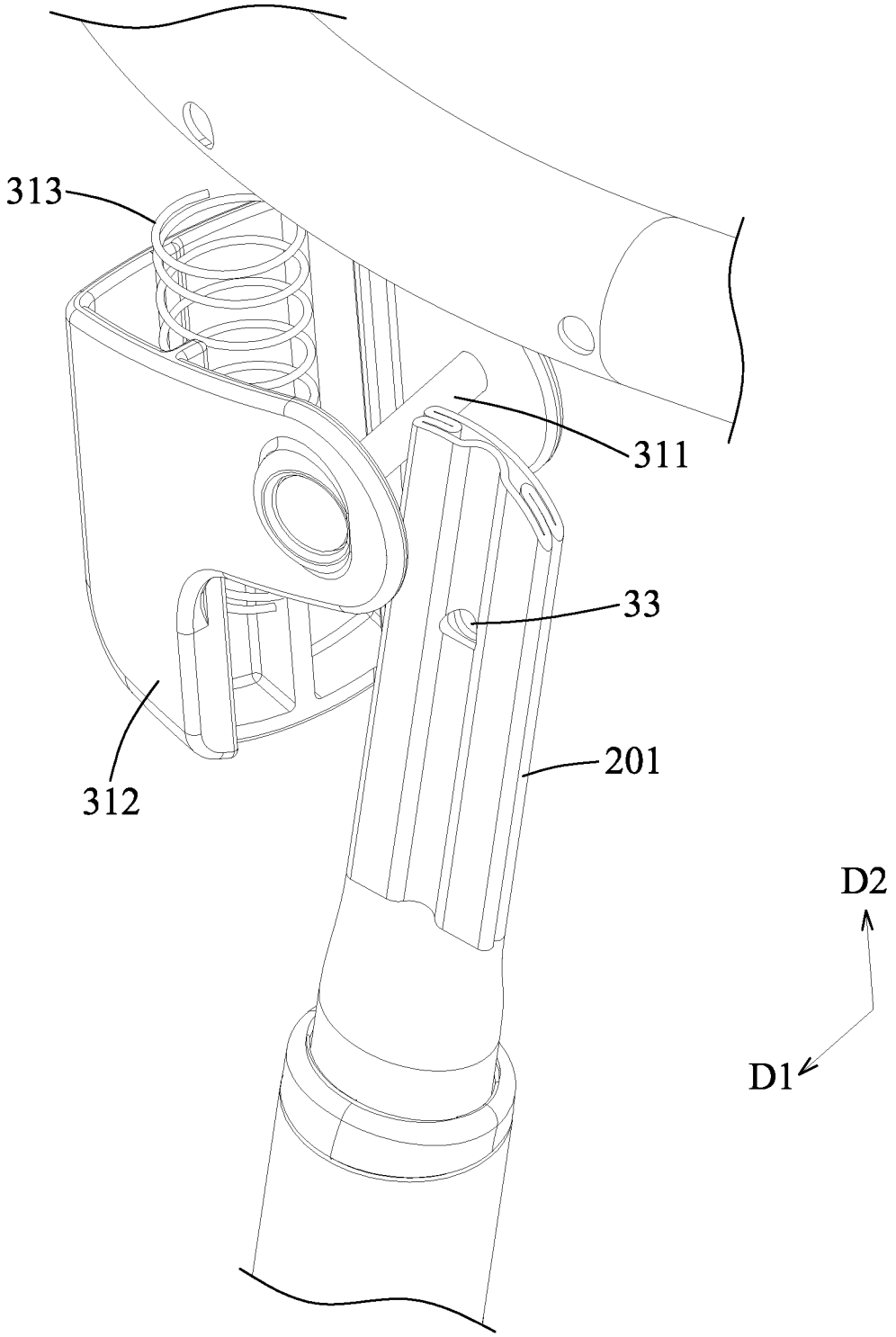
FIG. 7 is a fragmentary perspective view of a locking unit of the pivot hub, the corresponding leg unit, and an support frame of the first embodiment.
Figure 8:
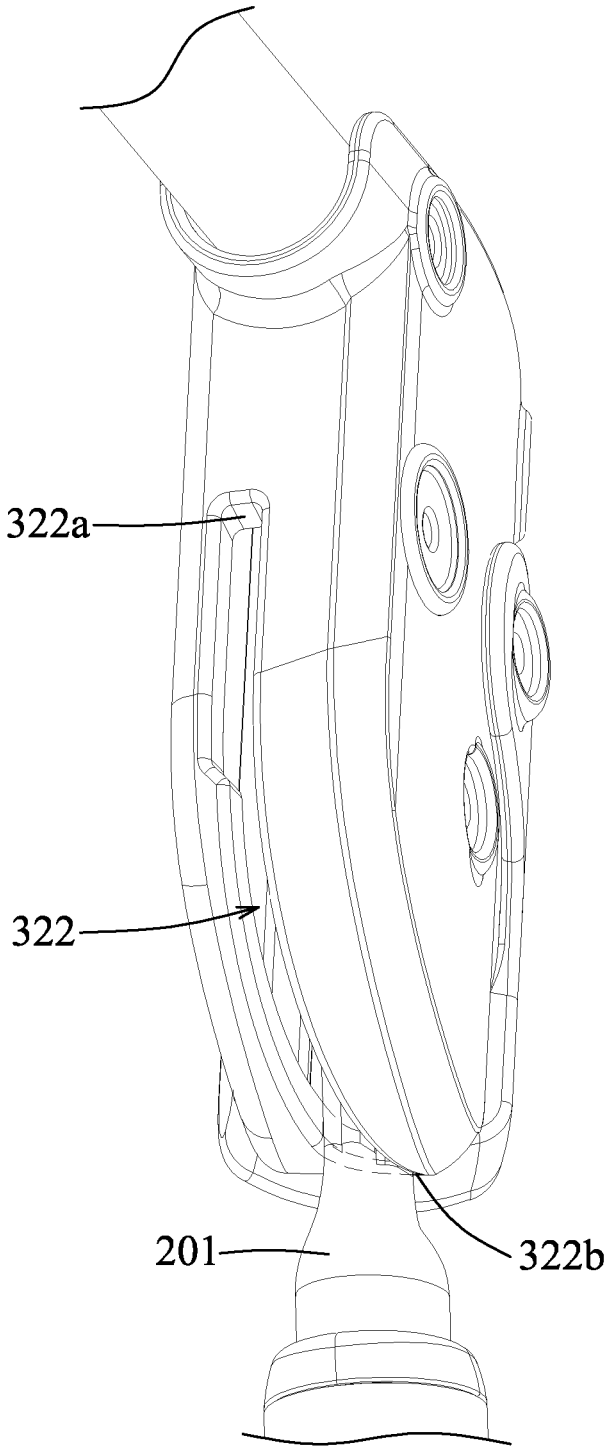
FIG. 8 is a fragmentary perspective view of the first embodiment, illustrating the corresponding leg unit at the unfolded position.
Figure 9:
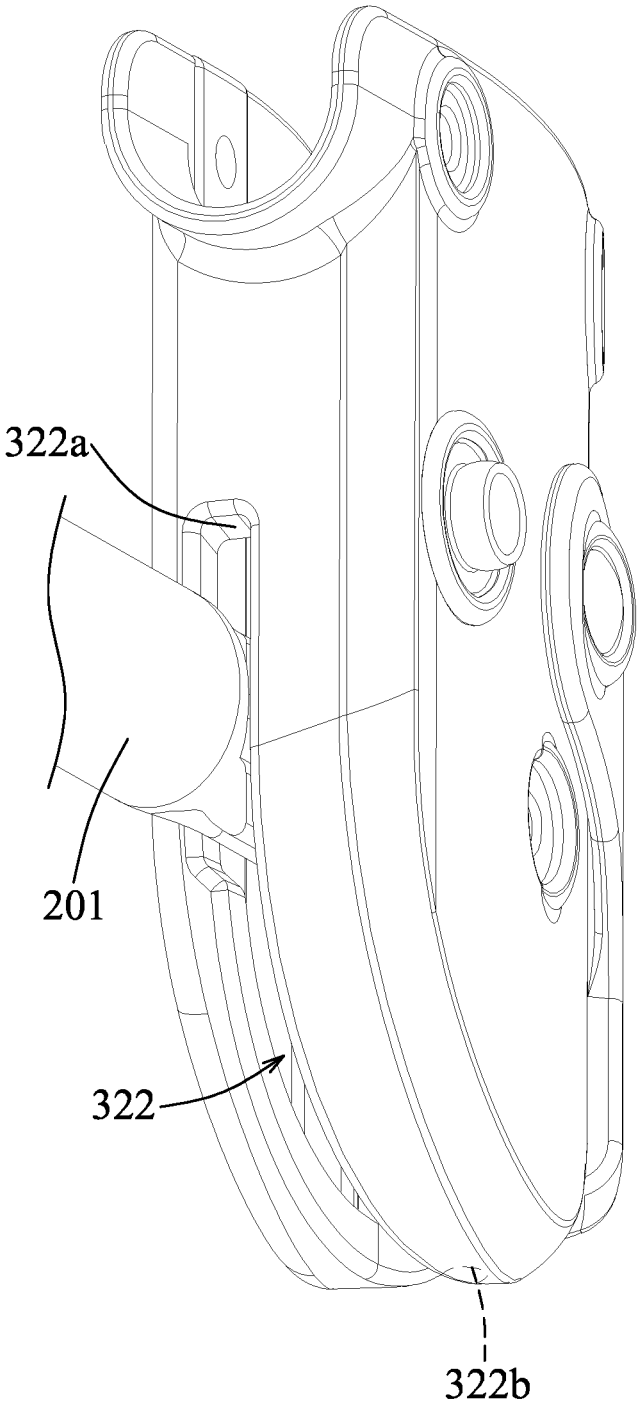
FIG. 9 is fragmentary perspective view of the pivot hub and the corresponding leg unit, illustrating the corresponding leg unit at the folded position.

Referring to FIG. 7, in this embodiment, the locking pin 311 extends in a first direction (D1) which is parallel to a pivot axis of the leg unit 2, and is movable in a second direction (D2) which is transverse to the first direction (D1) from the stopping position to the releasing position. The locking pin 311 abuts against the pivot end portion 201 of the respective leg unit 2 when the locking pin 311 is at the stopping position while the respective leg unit 2 is at the unfolded position.

Referring to FIGS. 6 to 9, the hub housing 32 is made of a flexible material and has a pin slot 321 extending in the second direction (D2), and a slot-defining surface defining a leg slot 322. In this embodiment, the locking pin 311 extends movably through the pin slot 321, and the locking resilient member 313 is connected between the operating member 312 and the hub housing 32 and extends along the second direction (D2).

The slot-defining surface has opposite upper and lower ends 322*a*, 322*b* serving respectively as upper and lower borders of the leg slot 322. The leg slot 322 has a large end portion and a small end portion that are respectively proximate to the upper and lower ends 322*a*, 322*b* of the leg slot 322. The small end portion is narrower than the large end portion and slightly narrower than the pivot end portion 201 of the leg unit 2. The pivot end portion 201 of the leg unit 2 extends through the leg slot 322 of the hub housing 32, abuts against the lower end 322*b* of the slot-defining surface of the hub housing 32 when the leg unit 2 is at the unfolded position (see FIG. 8), and is retained in the large end portion of the leg slot 322 of the hub housing 32 when the leg unit 2 is at the folded position (see FIG. 9). To move the leg unit 2 from the folded position to the unfolded position, a downward force is applied to the leg unit 2 which is large enough to allow the pivot end portion 201 of the leg unit 2 to push into the small end portion of the leg slot 322 of the pivot hub 3.

Figure 10:
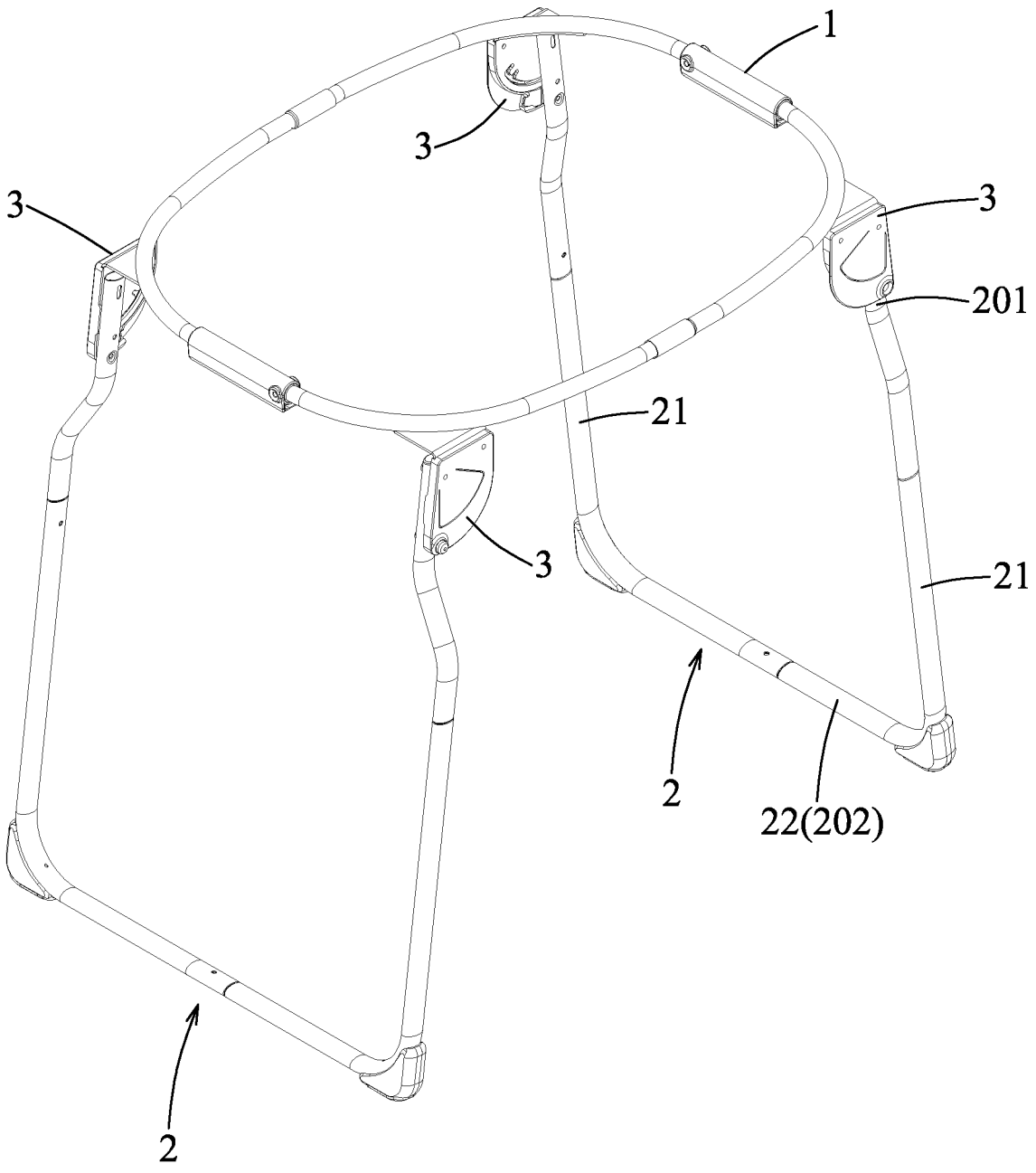
FIG. 10 is a perspective view of a second embodiment of a bassinet frame according to the disclosure, illustrating leg units of the second embodiment each at an unfolded position.
Figure 12:
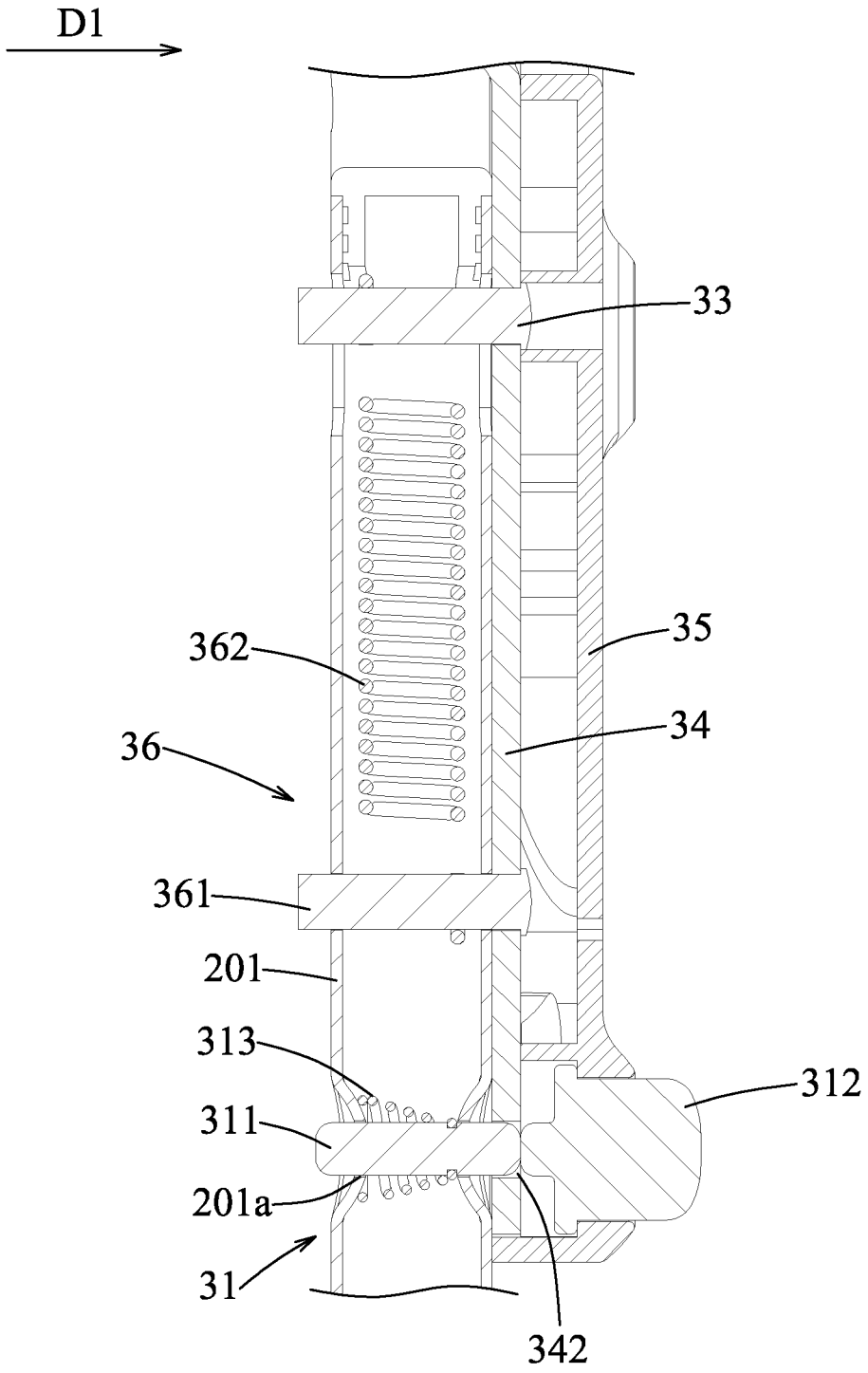
FIG. 12 is a fragmentary sectional view illustrating the pivot hub and a corresponding leg unit of the second embodiment.

Referring to FIGS. 10 and 12, a second embodiment of the bassinet frame differs from the first embodiment in the structure of the leg units 2 and the pivot hubs 3. Similarly, only one leg unit 2 and one pivot hub 3 will be described hereinafter.

In this embodiment, the legs 21 of the leg unit 2 are formed in one piece with the foot bar 22 such that the inner and outer tubes 212, 213 are omitted and the leg unit 2 is substantially U-shaped. Ends of the legs 21 that are connected to corresponding pivot hubs 3 serve as the pivot end portion 201 of the leg unit 2. In this embodiment, the pivot end portion 201 is formed with a pin hole 201*a*.

Figure 11:
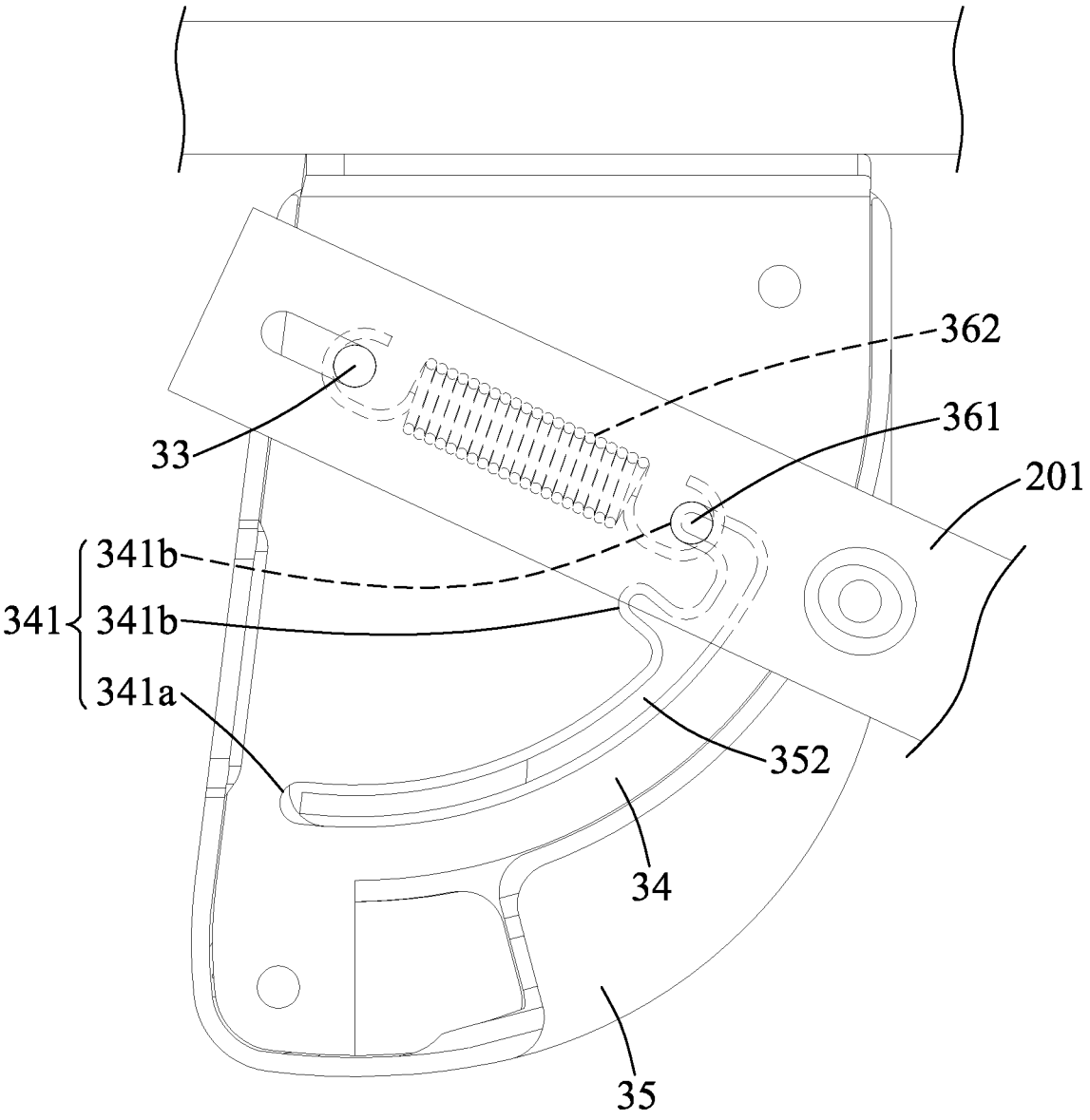
FIG. 11 is a fragmentary side view of the second embodiment, illustrating pivot and positioning rivets of a pivot hub in a secured state.
Figure 13:
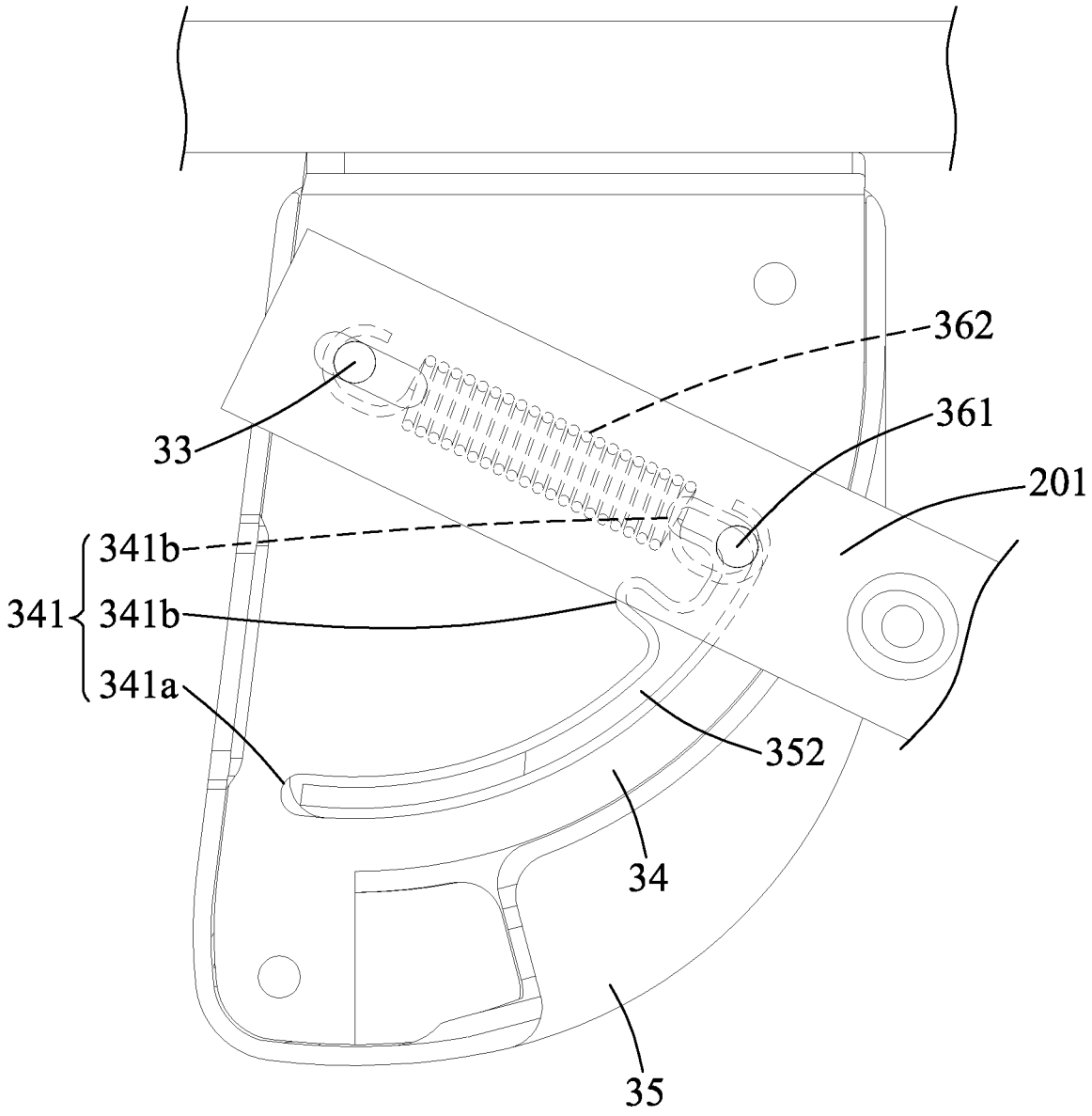
FIG. 13 is a view similar to FIG. 11, illustrating the pivot and positioning rivets in a movable state.

Referring to FIGS. 11 to 13, the pivot hub 3 further includes a positioning unit 36 and, in replacement of the hub housing 32, a hub plate 34 and a cover 35. The hub plate 34 has a locking hole 342 and a positioning groove 341 having an arc-shaped main segment 341*a* and two rivet slots 341*b* that extend from the main segment 341*a* toward the pivot rivet 33.

In this embodiment, the locking pin 311 of the locking unit 31 of the pivot hub 3 is mounted in the pin hole 201*a* of the pivot end portion 201 of the leg unit 2 and extends in the first direction (D1) into the locking hole 342 of the hub plate 34 at the stopping position while the leg unit 2 is at the unfolded position. The locking resilient member 313 is disposed in the pin hole 201*a* of the pivot end portion 201 of the leg unit 2 and connected between the locking pin 311 and the pivot end portion 201. The operating member 312 is aligned with the locking hole 342 of the hub plate 34 and is operable to move the locking pin 311 against a resilient force of the locking resilient member 313 out of the locking hole 342 of the hub plate 34 to the releasing position.

The positioning unit 36 includes a positioning rivet 361 and a positioning resilient member 362. The positioning rivet 361 is mounted to the pivot end portion 201 of the leg unit 2 and movably extends into the positioning groove 341. The positioning resilient member 362 interconnects the pivot rivet 33 and the positioning rivet 361. The pivot rivet 33 and the positioning rivet 361 are movable relative to each other against a resilient force of the positioning resilient member 362 from a secured state (see FIG. 11) where the positioning rivet 361 is disposed in one of the rivet slots 341*b* of the positioning groove 341, to a movable state (see FIG. 13), where the positioning rivet 361 is disposed in and movable along the main segment 341*a* of the positioning groove 341. When the pivot and positioning rivets 33, 361 are in the secured state, rotational movement of the pivot end portion 201 of the leg unit 2 is not permitted. In this embodiment, the pivot rivet 33 is movable relative to the leg unit 2 such that the leg unit 2 can be pulled away from the pivot hub 3 to change the pivot and positioning rivets 33, 361 of the pivot hub 3 from the secured state to the movable state.

Figure 14:
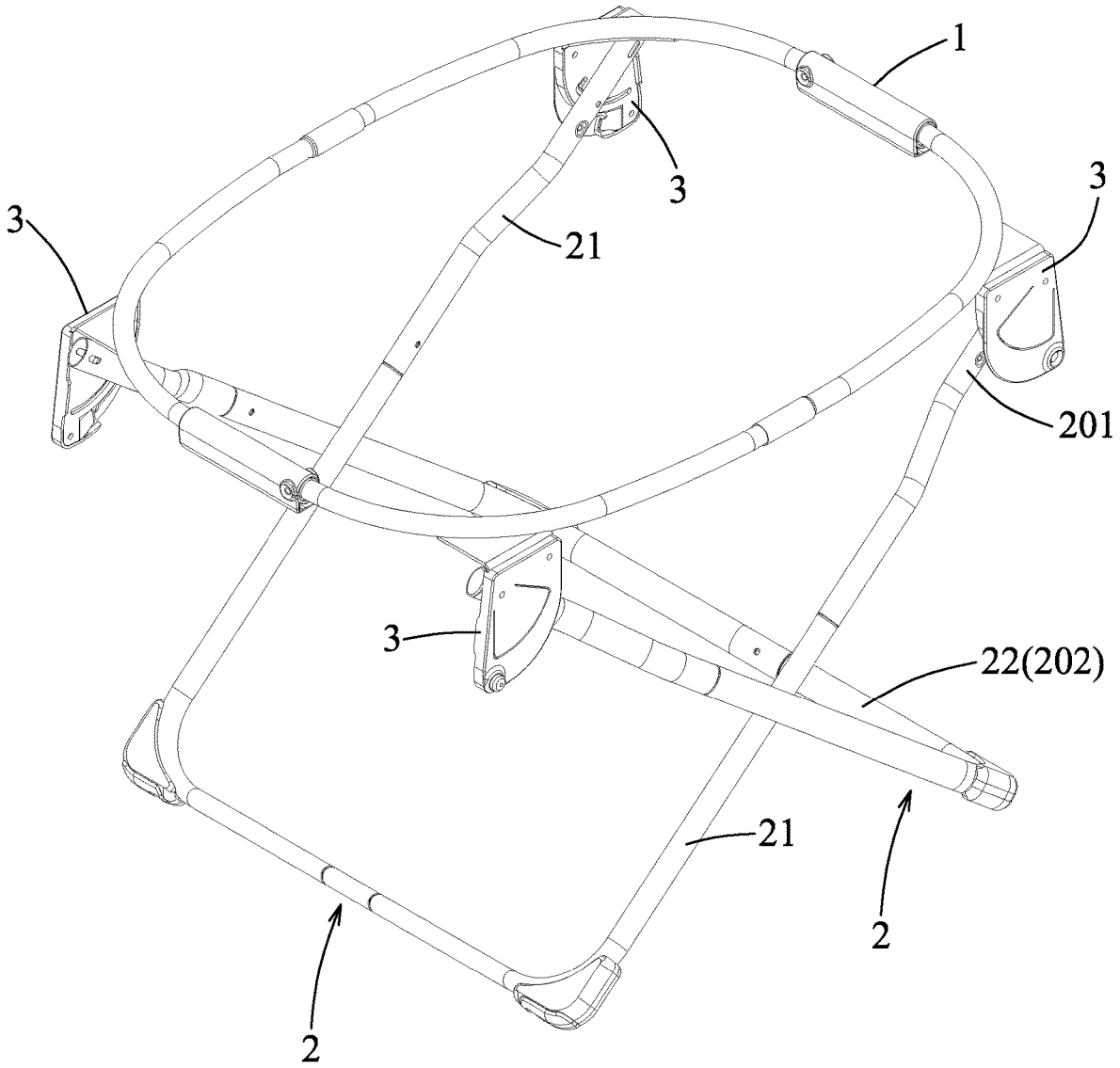
FIG. 14 is a view similar to FIG. 10, illustrating the leg units each at an intermediate position.
Figure 16:
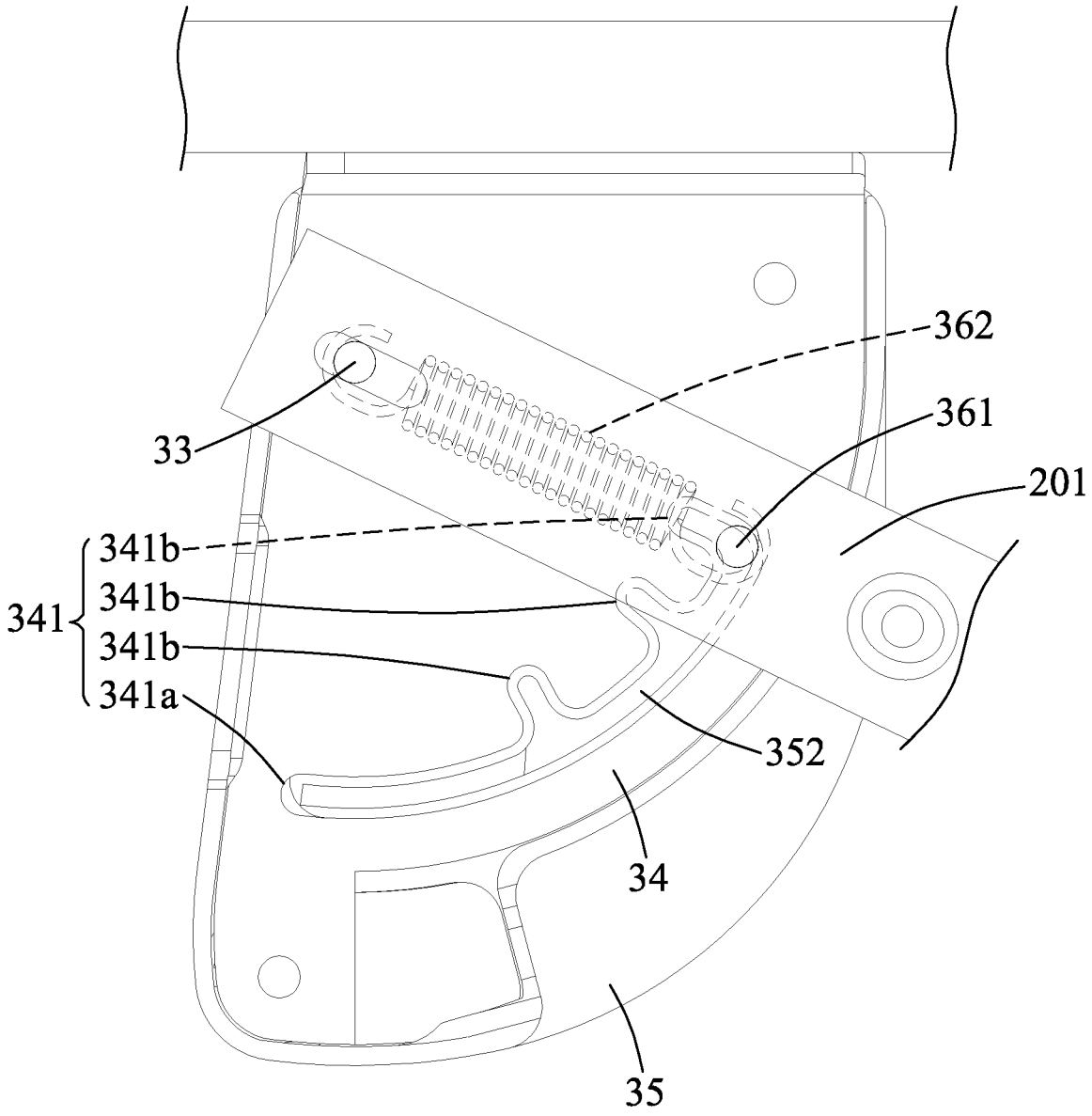
FIG. 16 is a fragmentary side view of another embodiment of a bassinet frame.

In this embodiment, the rivet slots 341*b* has an end slot that is disposed at an upper end of the main segment 341*a* and an intermediate slot disposed between the upper end and a lower end of the main segment 341*a*. The leg unit 2 is positioned at the folded position when the positioning rivet 361 is disposed in the end slot, and the leg unit 2 is positioned at an intermediate position (see FIG. 14) which is between the folded position and the unfolded position when the positioning rivet 361 is disposed in the intermediate slot. In this embodiment, the positioning unit 36 and the hub plate 34 are operable to adjust an angle between the support frame 1 and the leg unit 2 such that a height of the support frame 1 can be set. Referring to FIG. 16, in certain embodiments, the rivet slots 341*b* may have an end slot and a plurality of intermediate slots so that the leg unit 2 may be set at different angles to the support frame 1 and the height of the support frame 1 may be set to a number of intermediate heights between a maximum height and a minimum height. In other embodiments, different mechanisms such as a spring-loaded gear mechanism actuated with a button or a one-hand actuator located on the support frame may be used to achieve the same effect.

Figure 15:
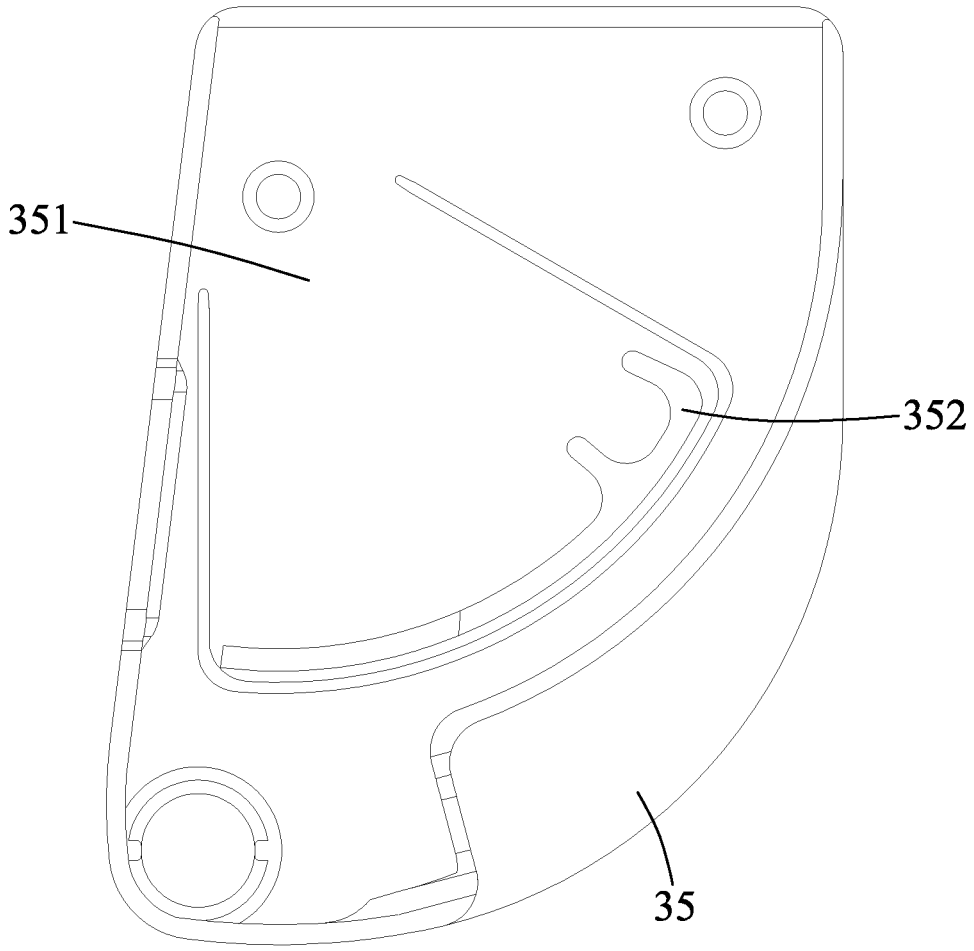
FIG. 15 is a perspective view of a cover of the pivot hub of the second embodiment.

Referring to FIGS. 11 and 15, the cover 35 has a deformable portion 351 and a rib 352 extending from the deformable portion 351 into the positioning groove 341 of the hub plate 34. The rib 352 has a thickness that decreases from an upper end to a lower end of the main segment 341*a* of the positioning groove 341, and the positioning rivet 361 pushes the rib 352 out of the positioning groove 341 and moves the deformable portion 351 of the cover 35 away from the hub plate 34 as the positioning rivet 361 is moved from the lower end toward the upper end of the main segment 341*a* of the positioning groove 341. In other words, the rib 352 fills the positioning groove 341 of the hub plate 34 when the respective leg unit 2 is at the unfolded position, and the rib 352 is deflected out of the positioning groove 341 via deformation of the deformable portion 351 when the leg unit 2 is moved away from the unfolded position.

It should be noted that, in other embodiments, the bassinet frame may be equipped with only two pivot hubs 3, and each pivot hub 3 interconnects the support frame 1 and one leg 21 of a respective one of the leg units 2.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but intended to cover various arrangements included within the spirit and scope of the broadest interpretation so as to encompass all such modifications and equivalent arrangements.

What is claimed is:

1. A bassinet frame comprising:

a support frame;

two leg units each having a pivot end portion and a foot portion that is opposite to said pivot end portion; and at least two pivot hubs each connecting a respective one of said leg units to said support frame, and each including a locking pin and a hub housing that is made of a flexible material and that has a slot-defining surface which defines a leg slot and which has opposite upper and lower ends serving respectively as upper and lower borders of said leg slot, said leg slot having a large end portion and a small end portion that are respectively proximate to said upper and lower ends, said small end portion being narrower than said large end portion and slightly narrower than said pivot end portion of said respective leg unit, said pivot end portion of each of said leg units extending through said leg slot of said hub housing of a respective one of said pivot hubs, and being pivotally connected to said respective one of said pivot hubs such that said leg units are pivotable relative to said pivot hubs and said locking pins;

wherein each of said leg units is pivotable relative to said support frame between a folded position and an unfolded position;

wherein, when each of said leg units is at the unfolded position, said foot portion thereof is distal from said support frame, said pivot end portion thereof is retained in said large end portion of said leg slot of said hub housing of said respective pivot hub and abuts against said lower end of said slot-defining surface of said respective pivot hub, and said locking pin of said respective pivot hub is movable between a stopping position, wherein said locking pin prevents a respective one of said leg units from moving toward the folded position, and a releasing position, wherein movement of said respective leg unit toward the folded position is permitted; and wherein, when each of said leg units is at the folded position, said foot portion thereof is proximal to said support frame, and said small end portion of said leg slot of said hub housing of each of said pivot hubs is allowed to become slightly wider so as to retain said pivot end portion of said respective leg unit therein in a manner that said pivot end portion of said respective leg unit is clamped by said hub housing of each of said pivot hubs via an elastic force of the flexible material.

2. The bassinet frame as claimed in claim 1, wherein for each of said pivot hubs, said locking pin extends in a first direction which is substantially parallel to a pivot axis of said respective leg unit, and is movable in a second direction which is transverse to the first direction from the stopping position to the releasing position, said locking pin abutting against said pivot end portion of said respective leg unit when said locking pin is at the stopping position while said respective leg unit is at the unfolded position, said locking pin being disengaged from said pivot end portion of said respective leg unit when said locking pin is at the releasing position.

3. The bassinet frame as claimed in claim 2, wherein each of said pivot hubs further includes an operating member connected to said locking pin, and a locking resilient member disposed between said support frame and said operating member, said operating member being operable to move said locking pin against a resilient force of said locking resilient member from the stopping position to the releasing position.

4. The bassinet frame as claimed in claim 3, wherein each of said pivot hubs further includes a hub housing mounted to said support frame and having a pin slot that extends in the second direction, said locking pin extending movably through said pin slot, said locking resilient member being connected between said operating member and said hub housing and extending along the second direction.

5. The bassinet frame as claimed in claim 1, wherein each of said leg units includes:

two legs, each of said legs including an inner tube and an outer tube coupled telescopically to each other, said inner tubes of said legs being connected pivotally to said support frame and serving as said pivot end portion of said leg unit; and a foot bar interconnecting said outer tubes of said legs and serving as said foot portion of said leg unit.

6. The bassinet frame as claimed in claim 5, wherein:

for each of said legs, said inner tube has an inner fastening hole, and said outer tube has an outer fastening hole; and each of said legs further includes a tube fastener extending into said inner fastening hole, said tube fastener being operable to extend retractably through said outer fastening hole for positioning said inner tube relative to said outer tube.

7. The bassinet frame as claimed in claim 1, wherein:

each of said pivot hubs further includes a hub plate having a locking hole; and said locking pin of each of said pivot hubs is mounted to said pivot end portion of said respective leg unit and extends in a first direction which is parallel to a pivot axis of said respective leg unit into said locking hole at the stopping position while said respective leg unit is at the unfolded position, said locking pin being operable to be retracted out of said locking hole to the releasing position.

8. The bassinet frame as claimed in claim 7, wherein:

said pivot end portion of each of said leg units is formed with a pin hole;

each of said pivot hubs further includes an operating member and a locking resilient member, said locking resilient member being disposed in said pin hole of said pivot end portion of said respective leg unit and connected between said locking pin and said pivot end portion, said operating member being aligned with said locking hole of said hub plate and being operable to move said locking pin against a resilient force of said locking resilient member out of said locking hole of said hub plate to the releasing position.

9. The bassinet frame as claimed in claim 1, wherein:

each of said pivot hubs includes:

a hub plate having a positioning groove that has an arc-shaped main segment and at least two rivet slots, a pivot rivet pivotally connecting said pivot end portion of said respective leg unit to said hub plate, said rivet slots of said positioning groove of said hub plate extending from said main segment toward said pivot rivet, and a positioning unit including:

a positioning rivet that is mounted to said pivot end portion of said respective leg unit and that movably extends into said positioning groove, and a positioning resilient member that interconnects said pivot rivet and said positioning rivet;

for each of said pivot hubs, said pivot rivet and said positioning rivet are movable relative to each other against a resilient force of said positioning resilient member from a secured state, wherein said positioning rivet is disposed in one of said at least two rivet slots of said positioning groove, to a movable state, wherein said positioning rivet is disposed in and movable along said main segment of said positioning groove; and for each of said pivot hubs, when said pivot and positioning rivets are in the secured state, rotational movement of said pivot end portion of said respective leg unit is not permitted.

10. The bassinet frame as claimed in claim 9, wherein for each of said pivot hubs:

said at least two rivet slots has an end slot that is disposed at an upper end of said main segment and at least one intermediate slot disposed between said upper end and a lower end of said main segment; and said respective leg unit is positioned at the folded position when said positioning rivet is disposed in said end slot.

11. The bassinet frame as claimed in claim 10, wherein said at least one intermediate slot has a plurality of intermediate slots disposed between said upper and lower ends of said main segment.

12. The bassinet frame as claimed in claim 9, wherein each of said pivot hubs further includes a cover disposed on a side of said hub plate opposite said positioning unit and having a deformable portion and a rib that extends from said deformable portion into said positioning groove of said hub plate.

13. The bassinet frame as claimed in claim 12, wherein for each of said pivot hubs, said rib has a thickness that decreases from an upper end to a lower end of said main segment of said positioning groove, said positioning rivet pushing said rib out of said positioning groove and moving said deformable portion of said cover away from said hub plate as said positioning rivet is moved from said lower end toward said upper end of said main segment of said positioning groove.

14. The bassinet frame as claimed in claim 1, wherein each of said pivot hubs further includes an operating member and a locking resilient member, said operating member being operable to move said locking pin against a resilient force of said locking resilient member from the stopping position to the releasing position.

* * * * *